US011767199B2

(12) United States Patent
O'Handley et al.

(10) Patent No.: US 11,767,199 B2
(45) Date of Patent: Sep. 26, 2023

(54) CRANE HOOK ROTATION-LIMITING DEVICE

(71) Applicant: Toyota Motor Engineering & Manufacturing North America, Inc., Plano, TX (US)

(72) Inventors: Troy A. O'Handley, Cambridge (CA); George P. Rachfalowski, Kitchener (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 164 days.

(21) Appl. No.: 17/481,596

(22) Filed: Sep. 22, 2021

(65) Prior Publication Data

US 2023/0091455 A1 Mar. 23, 2023

(51) Int. Cl.
*B66C 13/04* (2006.01)
*B66C 1/34* (2006.01)

(52) U.S. Cl.
CPC ..... *B66C 13/04* (2013.01); *B66C 1/34* (2013.01)

(58) Field of Classification Search
CPC .. B66C 1/16; B66C 1/34; B66C 13/04; B66C 13/08
USPC ..... 294/82.15, 82.16
See application file for complete search history.

(56) References Cited

U.S. PATENT DOCUMENTS

| | | | | | |
|---|---|---|---|---|---|
| 1,815,290 | A * | 7/1931 | Dedman | E21B 19/04 | 294/82.16 |
| 2,508,595 | A * | 5/1950 | Christensen | E21B 19/02 | 294/82.16 |
| 2,570,320 | A * | 10/1951 | Christensen | B66D 3/06 | 294/82.16 |
| 3,621,756 | A * | 11/1971 | Ulbing | B66F 3/242 | 91/216 R |
| 4,165,863 | A * | 8/1979 | Schreyer | B66D 3/26 | 294/82.16 |
| 6,491,329 | B1 * | 12/2002 | Smith | B66C 1/34 | 294/215 |
| 2021/0139291 | A1 * | 5/2021 | Sundar S Iyer | B66C 1/34 | |

FOREIGN PATENT DOCUMENTS

| | | |
|---|---|---|
| CN | 203545499 U | 4/2014 |
| CN | 204714356 U | 10/2015 |

* cited by examiner

*Primary Examiner* — Dean J Kramer
(74) *Attorney, Agent, or Firm* — Christopher G. Darrow; Darrow Mustafa PC

(57) ABSTRACT

A crane hook rotation-limiting device includes a mounting base and a plunger extending through a hole formed in the mounting base so as to be movable with respect to the mounting base. A spring first bearing portion is connected to the plunger so as to be movable with the plunger. A spring second bearing portion is positioned opposite the spring first bearing portion so as to be fixed with respect to the plunger during movement of the plunger. A spring member extends between the spring first bearing portion and the spring second bearing portion. A pair of crane hook rotation-limiting devices as described herein may be mounted to a crane hook assembly to control rotation of the crane hook during movement of the hook when the hook supports a sling spreader or a sling spreader and a die (or other item of tooling).

10 Claims, 5 Drawing Sheets

CRANE HOOK ROTATION-LIMITING DEVICE

TECHNICAL FIELD

The present invention relates to cranes for transporting dies and other heavy items of tooling in manufacturing plants and. more particularly, to a mechanism designed to limit rotation of a hook mounted on a crane during movement of the hook and when an item of tooling is suspended from the hook.

BACKGROUND

A crane structure may be used inside a manufacturing plant to move heavy dies and other tooling between locations. The crane structure may support a hook from which the tooling may be hung. The hook may be rotatably supported by the crane structure to enable an open mouth of the hook to be freely rotated to a desired orientation, and also to enable tooling suspended from the hook to be rotated to a desired orientation during positioning of the tooling in the plant. Slings may be hung from the hook to support a load spreader. Chains may be hung from the load spreader to support the tooling to be moved by the crane structure. The load spreader may keep the chains spaced apart for ease of attachment to the tooling, and may aid in distributing the weight of the tooling supported by the hook.

It has been found that when a freely rotating hook supporting slings and a load spreader is moved with no tooling suspended from the load spreader, the momentum of the load spreader may cause the hook and load spreader to rotate to an orientation where the chains supported by the load spreader are not in the proper position for attachment of a die thereto when the hook/load spreader/chain arrangement is lowered. It is then necessary for a human operator to climb up onto the tooling and manually align the chains so that the tooling may be attached to the chains. This creates a safety risk to the operator. However, it is also beneficial to allow the hook to rotate when tooling is suspended from the load spreader, to enable manual adjustments to portions of the tooling during positioning of the tooling on the plant floor. Thus, it would be advantageous to have a means to limit rotation of the hook when the hook does not support any tooling.

SUMMARY

In one aspect of the embodiments described herein, a crane hook rotation-limiting device is provided. The crane hook rotation-limiting device includes a mounting base and a plunger extending through a hole formed in the mounting base so as to be movable with respect to the mounting base. A spring first bearing portion is connected to the plunger so as to be movable with the plunger. A spring second bearing portion is positioned opposite the spring first bearing portion so as to be fixed with respect to the plunger during movement of the plunger. A spring member extends between the spring first bearing portion and the spring second bearing portion.

In another aspect of the embodiments described herein, a crane hook assembly structured to be supported by a crane structure is provided. The crane hook assembly includes a housing structured to rotatably support a crane hook, and a crane hook having a hook portion and a support portion extending through an opening in the housing. A collar engages the support portion to rotatably secure the hook to the housing, the collar being rotatable with the hook. A first crane hook rotation-limiting device is attached to the collar and is structured to contact a portion of the housing to limit a rotation of the hook in a first rotational direction. A second crane hook rotation-limiting device is also attached to the collar and is structured to contact a portion of the housing to limit a rotation of the hook in a second rotational direction opposite the first rotational direction.

DETAILED DESCRIPTION

Figure 1:
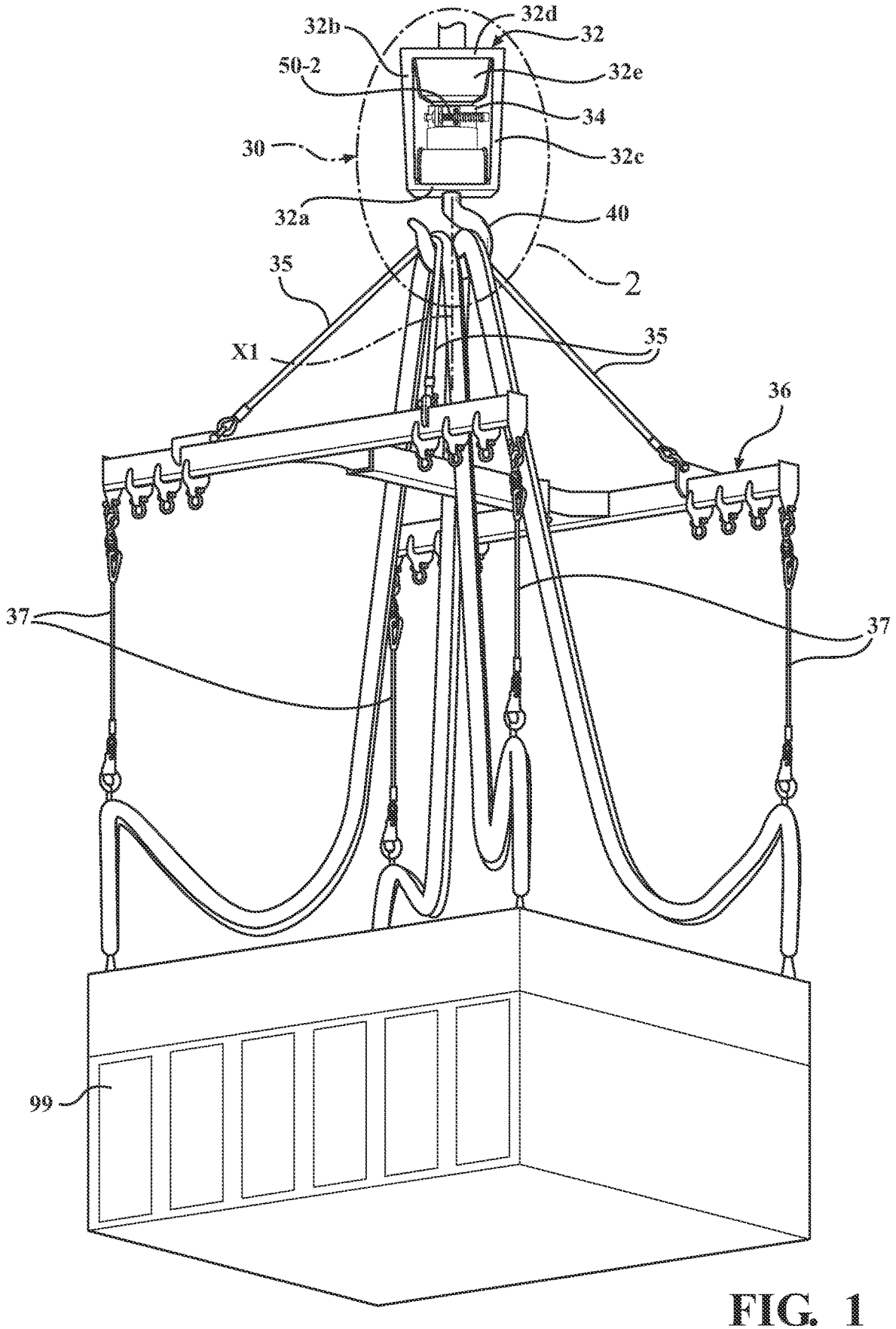
FIG. 1 is a schematic perspective view of a crane hook assembly in accordance with an embodiment described herein, shown supporting a sling spreader and an item of tooling.

Embodiments described herein relate to a crane hook rotation-limiting device. A housing supports a rotatable crane hook and a collar which is coupled to the hook so as to rotate in conjunction with the hook. A first crane hook rotation-limiting device as described herein may be attached to a first side the collar, and a second crane hook rotation-limiting device may be attached to a second side the collar opposite the first side. Each device includes a spring-loaded plunger which contacts the housing to exert a spring force on the housing. Rotation of the hook in one direction moves the plunger of the first device, thereby further compressing the spring of the first device and increasing the spring force generated by the first device. This acts to resist further rotation of the hook in the first direction. Rotation of the hook in an opposite direction moves the plunger of the second device, thereby further compressing the spring of the second device and increasing the spring force generated by the first device. This acts to resist further rotation of the hook in the second direction. Combined action of the first and second crane hook rotation-limiting devices acts to limit rotation of the crane hook due to momentum of loads supported by the hook, during movement of the hook.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. Unless otherwise noted, similar reference characters are used to describe similar features on separate elements and/or embodiments.

FIG. 1 is a schematic perspective view of a crane hook assembly (generally designated 30) in accordance with an embodiment described herein. The crane hook assembly 30 may be structured to be supported from above the hook assembly by a suitable crane structure (not shown). The crane structure may be mounted in a manufacturing plant or other facility. In one or more arrangements, for example, the crane structure may include tracks or guides structured to support the crane hook assembly for linear movement along a specified portion of the manufacturing plant. In another example, the crane hook assembly 30 may be supported by a jib extending from a mast. The mast may or may not be movable along a track in a floor of the manufacturing plant. The jib may be rotatable with respect to the mast, and the crane hook assembly 30 may be mounted on the jib so as to be movable along a length of the jib. Other crane hook assembly support arrangements are also possible. The crane hook assembly 30 may include a hook 40 rotatably supported in the hook assembly. "Rotatably supported" means that the hook 40 may rotate within the hook assembly 30 and with respect to the crane structure supporting the hook assembly 30, about a generally vertical axis of rotation X1. Referring to FIG. 1, an end of each of slings 35 may be connected to the hook 40, while a respective opposite end of each sling 35 may be connected to a sling spreader 36. Chains or cables 37 may be supported by the sling spreader 36 at spaced-apart locations designed to facilitate attachment of the chains/cables 37 to a die 99 or other piece of tooling.

Figure 2:
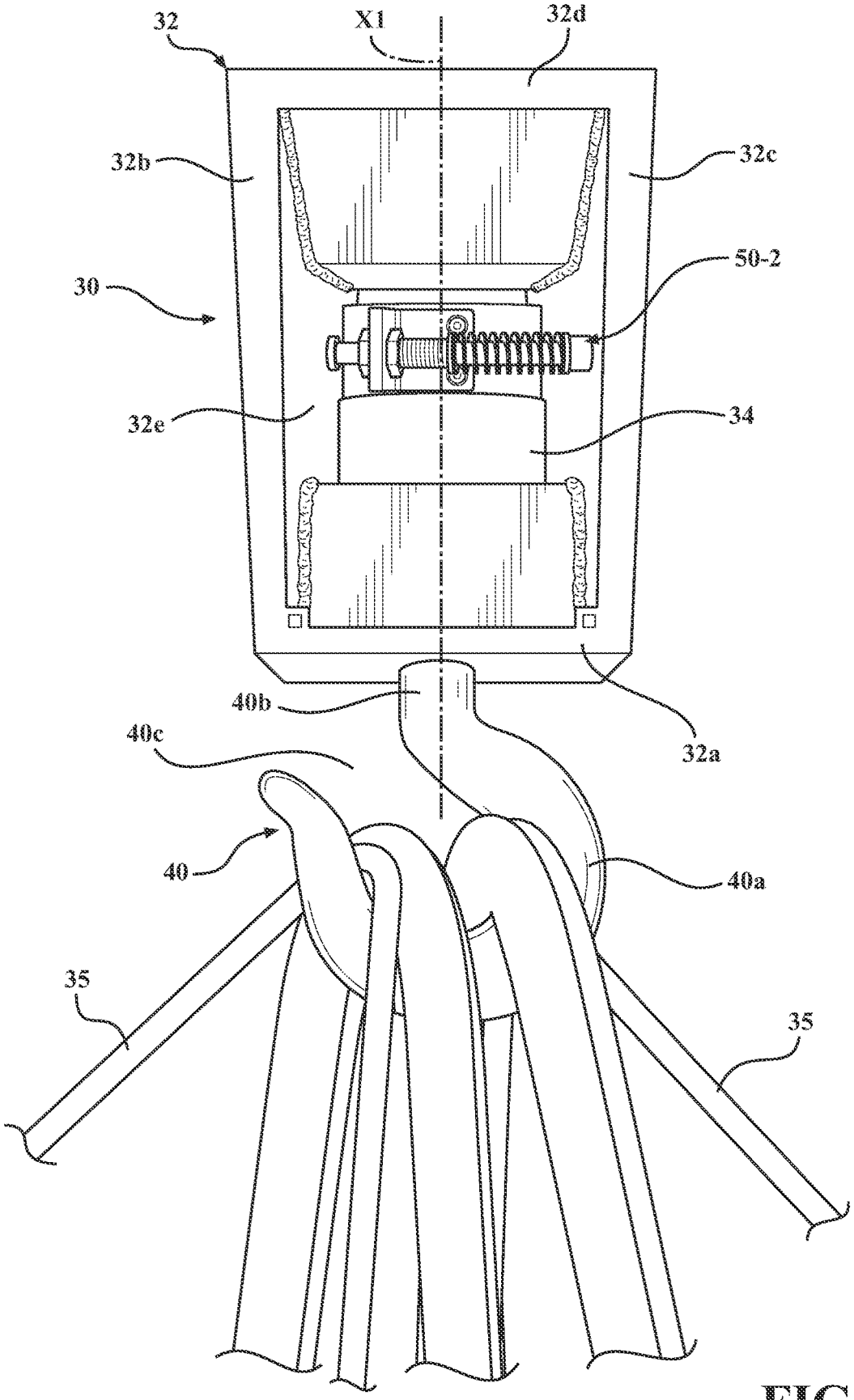
FIG. 2 is a magnified view of the crane hook assembly shown in FIG. 1.

FIG. 2 is a magnified view of the crane hook assembly 30 shown in FIG. 1. In one or more arrangements, the crane hook assembly 30 may include a housing 32 structured to be suspendable from a portion of the crane structure and to rotatably support the crane hook 40 so as to enable the hook 40 to be rotatable with respect to the housing 32 about axis X1. Housing 32 may have a base 32*a*, a pair of opposed walls 32*b*, 32*c* extending from opposite ends of the base 32*a*, and a flange 32*d* positioned opposite the base and connecting the walls 32*b* and 32*c*. The base 32*a*, walls 32*b*, 32*c*, and the flange 32*d* may combine to define a cavity 32*e* into which a support portion 40*b* of the hook 40 may extend, through an opening formed in the base 32*a*.

Referring to FIG. 2, crane hook 40 may have a hook portion 40*a* and support portion 40*b* structured to extend through an opening formed in the housing base 32*a*. Hook portion 40*a* may have an open mouth portion 40*c* structured to receive therein and engage portions of slings 35, chains, or other elements to be supported by the hook 40.

An end of the hook support portion 40*b* extending into the housing cavity 32*e* may be secured in the cavity 32*e* by application of a collar 34 to the end of the hook support portion 40*b*. The collar 34 may be attached to the hook support portion 40*b* (using threads, welds, pins, and/or any other suitable method) to rotatably secure the hook 40 to the housing 32, such that the collar 34 rotates in correspondence with the hook 40 about axis X1 (i.e., such that the collar 34 rotates with the hook 40 whenever the hook rotates, by the same amount as the hook and in the same direction as the hook).

In one or more arrangements, the hook 40 may be arranged so that the open mouth portion 40*c* is oriented toward any desired direction with respect to the housing 32 when the crane hook rotation-limiting devices 50-1 and 50-2 (described in greater detail below) are mounted on the collar 34 so that plungers 60-1 and 60-2 of the devices press against the same wall of the housing 32. After rotating the hook 40 to the desired rotational orientation with respect to the housing 32, the crane hook rotation-limiting devices 50-1 and 50-2 may be attached to the collar 34 to maintain the hook 40 in the desired rotational orientation when the springs of the rotation-limiting devices 50-1 and 50-2 are not loaded, and to exert restoring forces tending to rotate the hook 40 back toward the desired rotational orientation whenever to hook 40 is rotated out of the desired rotational orientation (for example, when the momentum generated by the sling spreader 36 and/or a suspended die 99 causes the hook 40 to rotate about axis X1).

Figure 3:
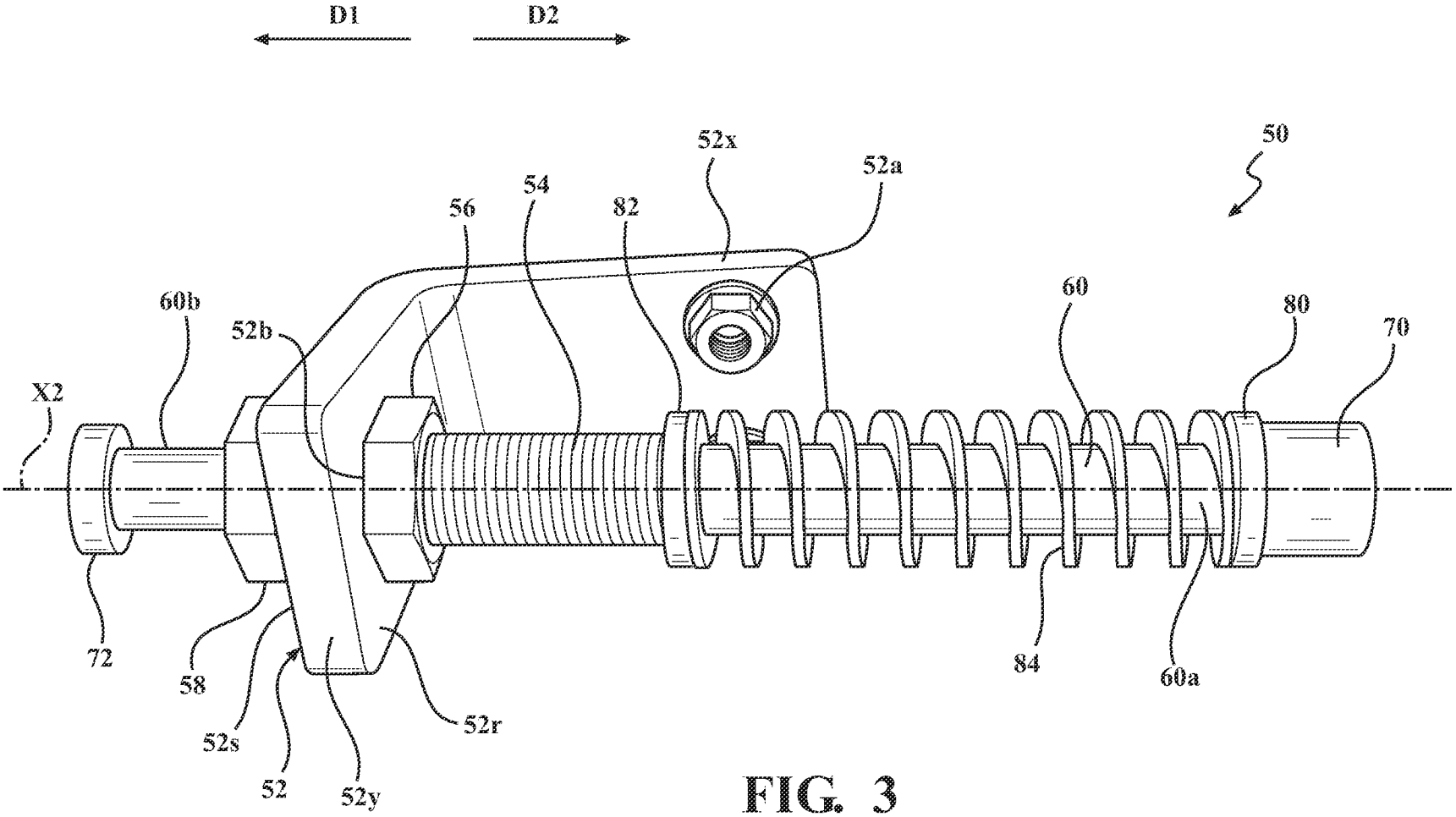
FIG. 3 is a schematic side view of a of a crane hook rotation-limiting device in accordance with an embodiment described herein.

Referring to FIG. 3, embodiments of the crane hook assembly 30 described herein may incorporate one or more embodiments of a crane hook rotation-limiting device, generally designated 50. Referring to FIG. 3, in one or more arrangements, an embodiment 50 of the crane hook rotation-limiting device may include a mounting base 52. In one or more arrangements, the mounting base 52 may be generally "L"-shaped with a first portion 52*x* structured for attachment to the collar 34 and a second portion 52*y* structured to extend from first portion 52*x* in a direction away from the collar 34 when the mounting base 52 is attached to the collar. Second portion 52*y* may have a first side 52*r* and a second side 52*s* opposite the first side 52*r*.

Mounting base 52 may have one or more mounting through-holes 52*a* enabling attachment of the rotation-limiting device 50 to a collar 34 of an associated crane hook assembly 30 using bolts, for example. Attachment of the mounting base 52 to the collar 34 enables the mounting base 52 and associated crane hook rotation-limiting device to rotate about axis X1 in correspondence with the collar 34 when the hook 40 rotates. Mounting base 52 may also have a through-hole 52*b* enabling a portion of a plunger guide 54 and/or a plunger 60 to extend therethrough as described herein. In one or more particular arrangements, the walls of the through-hole 52*b* may be threaded.

In the embodiment shown in FIG. 3, a plunger guide 54 may be secured in the hole 52*b*. The plunger guide may securable in a position extending either partially through the hole 52*b* or entirely through the hole 52*b* from the first side 52*r* of the mounting base second portion 52*y* to the second side 52*s* of the mounting base second portion 52*y* opposite the first side 52*r*. In one or more arrangements, the plunger guide 54 may be a hollow tube structured to enable a plunger 60 to extend through the tube interior so as to be movable along the tube interior. In one or more particular arrangements, the walls of the hole 52*b* may be threaded and the plunger guide 54 may be complementarily externally threaded so as to matingly engage the threads of the walls of the hole 52*b*. This structure may enable the plunger guide 54 to be adjustably positionable and securable (either by friction between the threads of the hole 52*b* and the threads of the plunger guide 54 during operation, or by another method (e.g., adhesive attachment)) to the mounting base 52 by inserting the plunger guide 54 into the hole 52*b* to threadedly engage the mounting base threads, and rotating the plunger guide 54 with respect to the mounting base 52 so that the plunger guide 54 moves along the hole 52*b* to a desired position with respect to the mounting base 52. Alternatively, the plunger guide 54 and the hole 52*b* may be dimensioned so as to enable formation of an interference fit between the guide 54 and the mounting base 52 when the guide 54 is inserted into the hole 52*b*. In yet another arrangement, the plunger guide 54 may be externally threaded, while the hole 52*b* may not be complementarily internally threaded, and the hollow plunger guide may fit through the hole 52*b* in a close clearance fit. In one or more particular arrangements, in cases where a movable plunger 60 extends through a hollow tubular plunger guide 54, suitable bearings (not shown) may be mounted in the hollow interior of the guide 54 to facilitate reciprocating motion of the plunger 60 in opposite directions D1 and D2 relative to the plunger guide 54, for the purposes described herein.

In particular embodiments where an externally-threaded hollow plunger guide 54 fits through the hole 52*b* in a close clearance fit and/or in embodiments where external threads of the guide 54 are dimensioned to matingly engage complementary internal threads of the hole 52*b*, a plunger guide positioning nuts 56, 58 may threadedly engage the plunger guide external threads and may be adjustably positionable along the exterior of the plunger guide 54 so as to prevent movement of the plunger guide in directions D1 and D2 when the guide 54 has been moved to a desired position with respect to the mounting base 52. More specifically, after the guide 54 has been moved along hole 52*b* to a desired position with respect to the mounting base 52, the first and second plunger guide positioning nuts 56, 58 may be rotated in opposite directions about a central longitudinal axis X2 of the plunger guide 54 until the first positioning nut 56 bears against the first side 52*r* of the mounting base portion 52*y*, and the second positioning nut 58 bears against the second side 52*s* of the mounting base portion 52*y*. This arrangement may secure the plunger guide 54 in the desired position with respect to the mounting base 52.

The plunger 60 may extend through the plunger guide between the first side 52*r* of the mounting base portion 52*y* to the second side 52*s* of the mounting base portion 52*y*, so as to be movable with respect to the mounting base 52 in directions D1 and D2. In particular arrangements, opposite ends 60*a* and 60*b* of the plunger may be internally or externally threaded to enable attachment of a cushion 70 to plunger first end 60*a* and a plunger stopper 72 to plunger second end 60*b* opposite the first end 60*a*. Alternatively, the plunger cushion 70 and plunger stopper 72 may be attached to respective ends of the plunger 60 using any other suitable method(s).

Cushion 70 may be structured to bear against one of housing walls 32*b*, 32*c* during operation of the crane hook rotation-limiting device. Cushion 70 may be formed from a polymer or hard rubber material.

Plunger stopper 72 may be formed form any suitable material, such as a polymer of a metal. The plunger stopper 72 may limit motion of the plunger 60 in direction D2 by preventing plunger end 60*b* from moving into the mounting base hole 52*b* from the second side 52*s* of the mounting base portion 52*y*.

Referring again to FIG. 3, a spring first bearing portion 80 may be attached to the plunger 60 proximate the plunger first end 60*a*. In one or more arrangements, the spring first bearing portion 80 may be a threaded washer or nut structured to matingly engage a complementarily threaded portion of the plunger 60, to enable adjustable positioning of the spring first bearing portion 80 at a desired location along the plunger. In other arrangements, the spring first bearing portion 80 may be fixedly attached to a particular location along the plunger. In all arrangements, the spring first bearing portion 80 may be structured so as to be fixable at a desired location along the plunger prior to movement of the plunger 60 during operation of the crane hook rotation-limiting device 50.

In addition, a spring second bearing portion 82 may be adjustably securable to the plunger guide 54 in a desired location along the plunger guide, so as to be fixed with respect to the moving plunger 60 as the plunger moves in directions D1 and D2 through the plunger guide. In one or more arrangements, the spring second bearing portion 82 may be a threaded washer or nut structured to matingly engage the external threads on the plunger guide 54, to enable adjustable positioning of the spring second bearing portion 82 at a desired location along the plunger guide. When positioned in a desired location, the spring second bearing portion 82 may be secured in the desired location using any of a variety of methods. FIG. 3 shows the spring second bearing portion 82 positioned near an end of the plunger guide 54. The spring first and second bearing portions 80, 82 operate as stops at the ends of the spring member 84 and aid in controlling pre-compression of the spring member.

A spring member 84 is structured to extend between spring first and second bearing portions 80, 82. As seen in FIG. 3, in one or more arrangements, the spring member 84 may be a coil spring, although other types of springs may be used. Spring member 84 may be structured to extend along the exterior of plunger 60 and also along the exterior of plunger guide 54 (if necessary, depending on the positioning of spring second bearing portion 82). Due to the positioning of spring first and second bearing portions 80, 82, movement of plunger 60 in direction D1 acts to compress the spring member, and movement of the plunger in direction D2 allows the spring member to extend or expand toward its undeflected condition.

Figure 4:
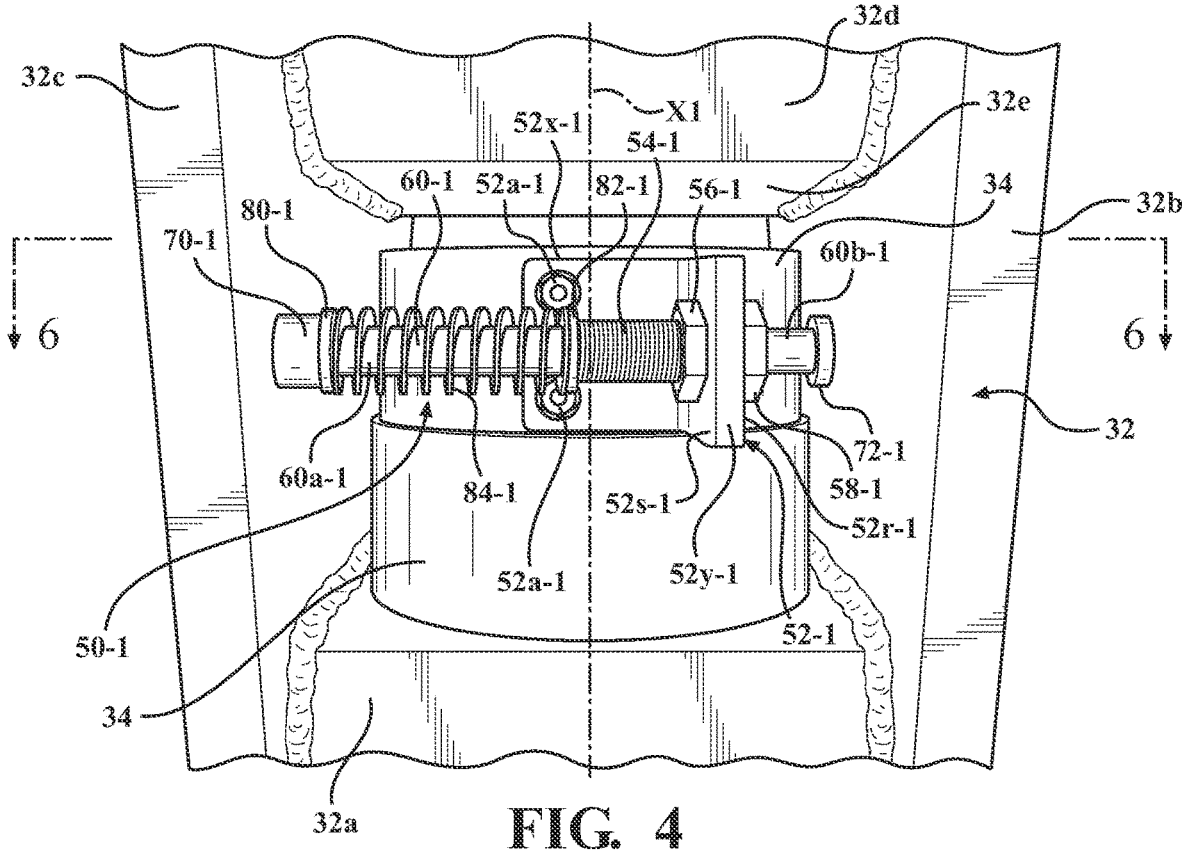
FIG. 4 is a schematic side view of a portion of a crane hook assembly as previously described showing a first crane hook rotation-limiting device attached to a first side of a collar which rotatably secures a hook to a housing of the crane hook assembly as shown in FIGS. 1 and 2.
Figure 5:
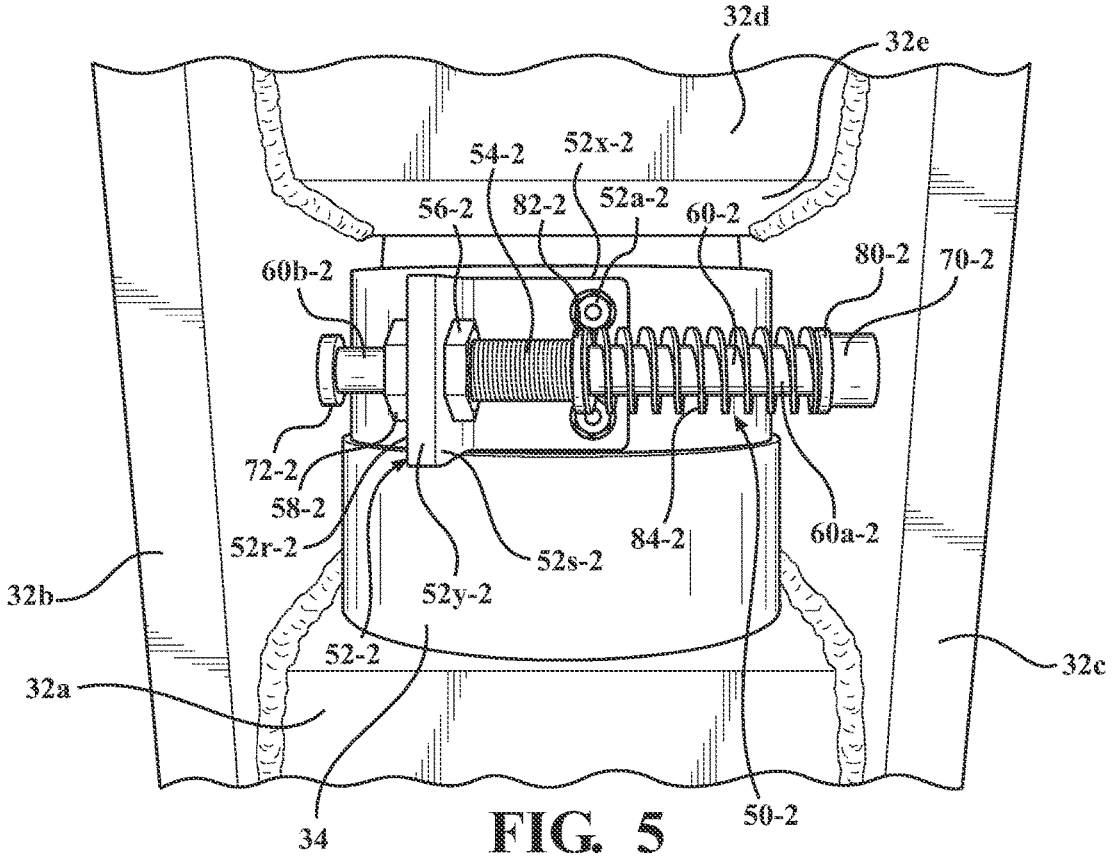
FIG. 5 is a schematic side view of the portion of a crane hook assembly in FIG. 4, showing a second crane hook rotation-limiting device attached to a second side of the collar opposite the first side of the collar.
Figure 6:
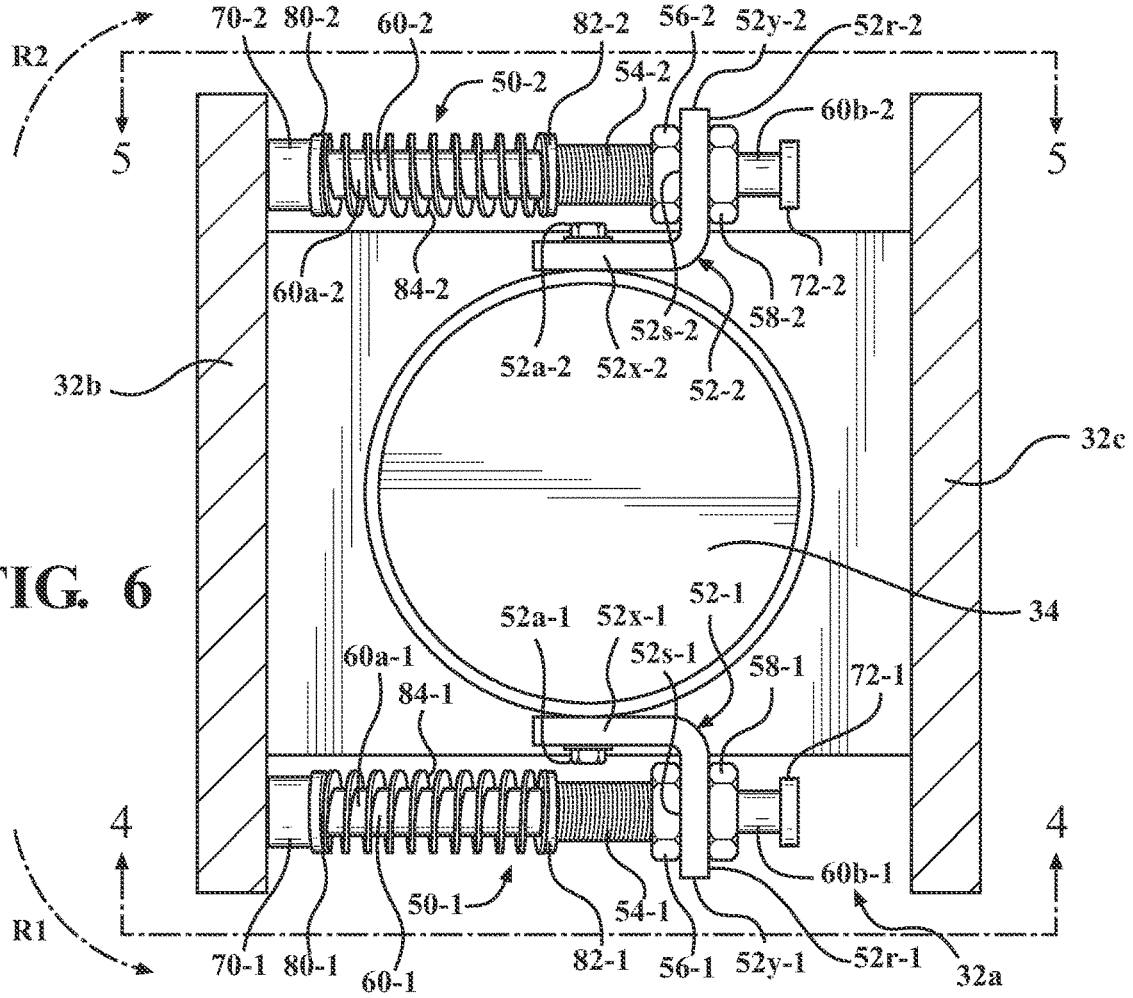
FIG. 6 is a schematic plan cross-sectional view of the crane hook assembly of FIGS. 4 and 5 showing the positions of the first and second crane hook rotation-limiting devices mounted along the exterior of the collar.

FIGS. 4-6 illustrate mounting and operation of the embodiment of a crane hook rotation-limiting device shown in FIG. 3. FIG. 4 is a schematic side view of a portion of a crane hook assembly 30 as previously described showing a crane hook rotation-limiting device 50-1 attached to a first side of a collar 34 which rotatably secures a hook (not shown) to the housing of the crane hook assembly as shown in FIGS. 1 and 2. FIG. 5 is a schematic side view of the portion of a crane hook assembly 30 showing a crane hook rotation-limiting device 50-2 attached to a second side of the collar 34 opposite the first side of the collar. FIG. 6 is a schematic plan cross-sectional view of the crane hook assembly of FIGS. 4 and 5 showing the positions of the crane hook rotation-limiting devices 50-1 and 50-2 along the exterior of the collar 34.

As seen in FIGS. 4-6, the crane hook assembly 30 may incorporate a pair of crane hook rotation-limiting devices 50-1 and 50-2 as shown in FIG. 3 mounted on opposite sides of the collar 34. In one or more arrangements, the crane hook rotation-limiting devices 50-1 and 50-2 may be spaced apart 180° along the collar exterior.

As seen in FIGS. 4-6, crane hook rotation-limiting devices 50-1 and 50-2 may be attached to the collar 34 and adjusted so that the respective plungers 60-1 and 60-2 of the rotation-limiting devices press against a single wall of 32*c* of the housing 32 when the rotation-limiting devices 50-1 and 50-2 are attached to the collar 34. The forces exerted by the spring-loaded plungers 60-1 and 60-2 on the wall 32*b* may be adjusted or controlled by selection of the spring members 84-1 and 84-2 and/or by adjusting the pre-compressions of the spring members 84-1, 84-2. Adjusting the pre-compressions of the spring members may be done by adjusting the positions of the spring second bearing portions 82-1 and 82-2 along their respective plunger guides 54-1 and 54-2 as previously described and/or by adjusting (using positioning nuts 56-1, 56-2, 58-1, 58-2) the positions of the plunger guides 54-1 and 54-2 with respect to the respective mounting base second portions 52*y*-1 and 52*y*-2.

Prior to attachment of a sling spreader 36 to the hook 40 as shown in FIG. 1, the hook 40 may be maintained in a desired rotational orientation with respect to the housing by spring forces exerted by rotation-limiting devices 50-1 and 50-2, as previously described. The "pre-compressions" of the spring members 84-1 and 84-2 are the compressions of the spring members 84-1 and 84-2 when the hook 40 is in the desired rotational orientation with respect to the housing 32, with no forces acting on the hook 40 which may tend to rotate the hook. In this respect, the desired rotational orientation of the hook 40 is a dwell or "ground" state of the hook maintained by forces exerted by the crane hook rotation-limiting devices 50-1 and 50-2.

After attachment of a sling spreader 36 to the hook 40, and during rotational and or translational movement of the crane assembly housing 32, forces tending to rotate the hook 40 about axis X1 may be generated due to static inertia and/or momentum of the sling spreader 36. Referring to FIG. 6, forces tending to rotate the hook 40 and the attached collar 34 in a first rotational direction R1 with respect to housing 32 will tend to compress the spring member 84-2 of rotation-limiting device 50-2 and may be resisted by the spring member 84-2. Similarly, forces tending to rotate the hook 40 and the attached collar 34 in a second rotational direction R2 with respect to housing 32 will tend to compress the spring member 84-1 of rotation-limiting device 50-1 and may be resisted by the spring member 84-1. Any compression of a spring member caused by rotation of the hook 40 (and the collar 34 rotationally attached to the hook) will increase the restoring force exerted by the spring, which tends to rotate the hook 40 back to the ground state of the hook. Thus, rotation of the hook 40 in direction R1 may cause compression of spring member 84-2 beyond its pre-compressed state as shown in FIG. 6. The compressed spring member 84-2 may then produce a reaction force tending to rotate the hook 40 in direction R1 back toward its ground state. Also, rotation of the hook 40 in direction R2 may cause compression of spring member 84-1 beyond its pre-compressed state as shown in FIG. 6. The compressed spring member 84-1 may then produce a reaction force tending to rotate the hook 40 in direction R2 back toward its ground state.

In the manner just described, by suitable adjustment of the spring forces, the rotation of the hook 40 responsive to movement of the sling spreader 36 may be limited to a maximum angular amount in either of directions R1 and/or R2 from the ground state. Details of the various spring force control parameters may be adjusted analytically and/or experimentally according to the projected speed of rotation and/or linear movement of the crane hook assembly, the mass of the sling spreader, and other pertinent factors.

In cases where a die 99 is supported by the hook 40 in addition to the sling spreader (as shown in FIG. 1), the inertial and momentum forces generated may be greater than those generated when the sling spreader 36 alone is supported by the crane hook assembly. Thus, the spring members 84-1, 84-2 may compress by greater amounts during movement of a die and a sling spreader 36 than during movement of the sling spreader alone. If it is desired to limit rotation of the hook 40 with both the sling spreader 36 and a die 99 supported by the hook, details of the various spring force control parameters may be adjusted in the same manner as previously described for movement of the sling spreader alone.

Figure 7:
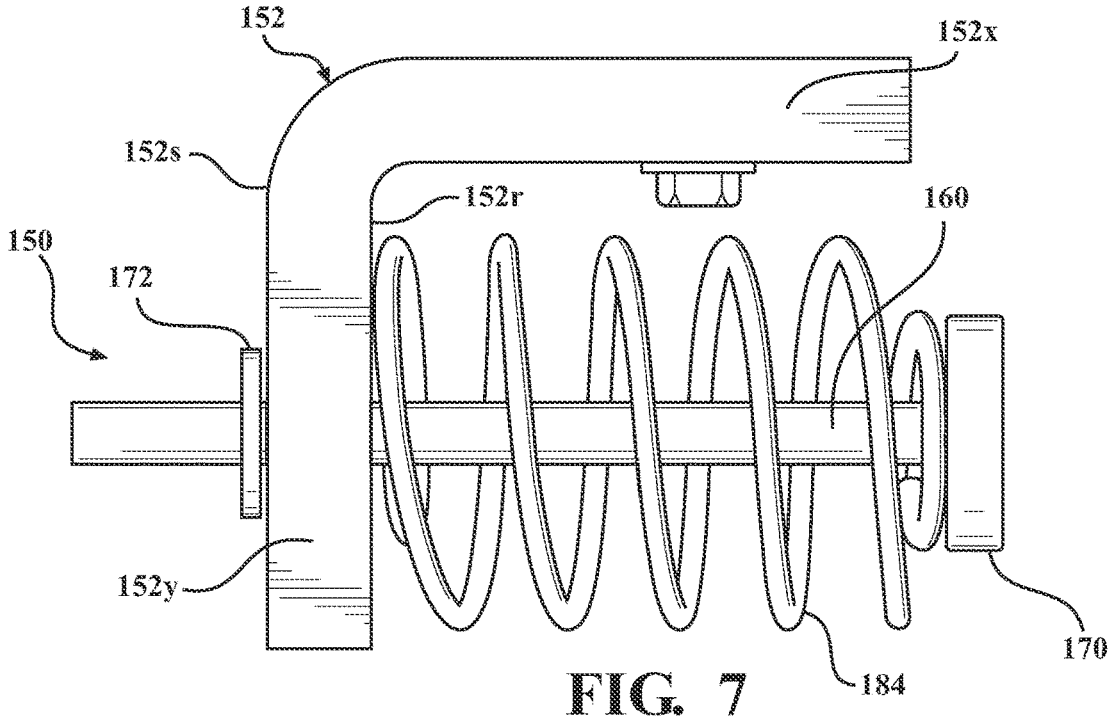
FIG. 7 is a schematic side view of a of a crane hook rotation-limiting device in accordance with another embodiment described herein.

FIG. 7 is a schematic side view of an alternative embodiment 150 of the crane hook rotation-limiting device. The crane hook rotation-limiting device 150 may include a mounting base 152 structured the same as mounting base 52 to have a first portion 152*x* and a second portion 152*y* as previously described. The device 150 may also have a spring member 184, a plunger 160, a spring first bearing portion/cushion 170, and a plunger stopper 172 similar to stopper 72 previously described.

In the embodiment shown, the plunger guide may be omitted and the function of the spring second bearing portion may be performed by the mounting base second portion 152*y*. Spring member pre-compression may be adjusted by adjusting the location along the plunger 160 at which the plunger stopper 172 is attached to the plunger along the second side 152*r* of the mounting base second portion 152*y*. For example, for a greater amount of pre-compression, the plunger stopper 172 may be attached to the plunger 160 at a location relatively closer to the cushion 170, and the secured in the desired position along the plunger 160 to pre-compress the spring member 184. Otherwise, the embodiment shown in FIG. 7 may operate in the same manner as the embodiment shown in FIG. 3.

In the above detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A crane hook rotation-limiting device comprising:

a mounting base;

a plunger extending through a hole formed in the mounting base so as to be movable with respect to the mounting base, the plunger including a first end;

a cushion attached to the plunger first end;

a spring first bearing portion connected to the plunger so as to be movable with the plunger;

a spring second bearing portion positioned opposite the spring first bearing portion so as to be fixed with respect to the plunger during movement of the plunger; and a spring member extending between the spring first bearing portion and the spring second bearing portion.

2. The crane hook rotation-limiting device of claim 1 wherein the spring second bearing portion is formed by a portion of the mounting base.

3. The crane hook rotation-limiting device of claim 1 wherein the spring member is positioned along a first side of the mounting base, and wherein the rotation-limiting device further comprises a plunger stopper connected to the plunger along a second side of the mounting base opposite the first side.

4. The crane hook rotation-limiting device of claim 3 wherein the plunger stopper is structured to be adjustably positionable and securable along the plunger.

5. A crane hook rotation-limiting device comprising:

a mounting base;

a plunger extending through a hole formed in the mounting base so as to be movable with respect to the mounting base;

a spring first bearing portion connected to the plunger so as to be movable with the plunger;

a spring second bearing portion positioned opposite the spring first bearing portion so as to be fixed with respect to the plunger during movement of the plunger;

a spring member extending between the spring first bearing portion and the spring second bearing portion; and a plunger guide adjustably positionable and securable to the mounting base, and wherein the plunger is supported by the plunger guide so as to be movable in a first direction along a longitudinal axis of the plunger and in a second direction opposite the first direction.

6. The crane hook rotation-limiting device of claim 5 wherein the spring second bearing portion is structured to be adjustably positionable along the plunger guide.

7. The crane hook rotation-limiting device of claim 5 wherein the hole in the mounting base is threaded, wherein the plunger guide comprises a hollow tube defining an interior, the tube being externally threaded so as to be threadedly engageable with threads of the hole in the mounting base, wherein the tube extends at least partially into the hole in the mounting base, and wherein the plunger extends through the interior of the tube.

8. The crane hook rotation-limiting device of claim 5 wherein the plunger guide comprises an externally threaded hollow tube extending through the hole in the mounting base between a first side of the mounting base and a second side of the mounting base opposite the first side, and wherein the rotation-limiting device further comprises:

a first plunger guide positioning nut threadedly engaging the tube along the first side of the mounting base; and a second plunger guide positioning nut threadedly engaging the tube along the second side of the mounting base.

9. A crane hook assembly comprising a pair of crane hook rotation-limiting devices, each crane hook rotation-limiting device including:

a mounting base;

a plunger extending through a hole formed in the mounting base so as to be movable with respect to the mounting base;

a spring first bearing portion connected to the plunger so as to be movable with the plunger;

a spring second bearing portion positioned opposite the spring first bearing portion so as to be fixed with respect to the plunger during movement of the plunger; and a spring member extending between the spring first bearing portion and the spring second bearing portion.

10. A crane hook assembly structured to be supported by a crane structure, the hook assembly comprising:

a housing structured to rotatably support a crane hook;

a crane hook having a hook portion and a support portion extending through an opening in the housing;

a collar engaging the support portion to rotatably secure the hook to the housing, the collar being rotatable with the hook;

a first crane hook rotation-limiting device attached to the collar and including a plunger structured to contact a portion of the housing to limit a rotation of the hook in a first rotational direction; and a second crane hook rotation-limiting device attached to the collar and including a plunger structured to contact a portion of the housing to limit a rotation of the hook in a second rotational direction opposite the first rotational direction.

* * * * *